US005274863A

United States Patent [19]

Fountain

[11] Patent Number: 5,274,863

[45] Date of Patent: Jan. 4, 1994

[54] CHILDS HAMMOCK

[76] Inventor: Roslyn B. Fountain, 61 Laurence Street, Christchurch, New Zealand

[21] Appl. No.: 865,917

[22] Filed: Apr. 9, 1992

[51] Int. Cl.[5] ..... A45F 3/22; A47D 13/00

[52] U.S. Cl. ..... 5/120; 5/98.3; 5/122

[58] Field of Search ..... 5/94, 98.3, 120, 121, 5/122, 123, 127

[56] References Cited

U.S. PATENT DOCUMENTS

| | | | |
|---|---|---|---|
| 485,081 | 10/1892 | Baird | 5/98.3 X |
| 1,204,416 | 11/1916 | Doser | 5/94 |
| 1,252,824 | 1/1918 | Melniker | 5/98.3 |
| 1,277,781 | 9/1918 | Trammell | 5/94 |
| 1,543,814 | 6/1925 | Banning | 5/98.3 X |
| 4,375,110 | 3/1983 | Murphy | 5/98.3 |
| 4,550,456 | 11/1985 | Allen | 5/98.3 |
| 4,941,453 | 7/1990 | Shakas et al. | 5/98.3 X |

*Primary Examiner*—Michael F. Trettel
*Attorney, Agent, or Firm*—Ladas & Parry

[57] ABSTRACT

A hammock for a child's cot, stand or frame which provides a relatively soft and rockable surface on which to lay a resting or sleeping child. The hammock comprises a generally rectangular shaped frame shaped to fit within a cot or to be suspended from a stand or frame, the shaped frame supports a fabric hammock region to which is attached supporting means to enable the hammock region to act as a sleeping platform suspended from the cot, stand or frame.

4 Claims, 3 Drawing Sheets

CHILDS HAMMOCK

FIELD OF THE INVENTION

The invention relates to a hammock and particularly to a child's hammock for a cot, stand or frame.

BACKGROUND OF THE INVENTION

Childrens cots as presently manufactured are normally produced with high sides at least one of which is slidable up or down to allow a parent to place a child on the mattress in the base of the cot. A common problem with an existing cot is that if the child is asleep or nearly asleep when it is placed on the mattress it often wakes up even when it is very carefully laid on the mattress. This is caused by the mattress being a relatively hard surface on which the child is laid. This is especially a problem if the child is laid in the cot while the side(s) is (are) in their up position.

An object of the invention is to provide a hammock for a childs cot, stand or frame which provides a relatively soft and rockable surface on which to lay a resting or sleeping child.

A further object of the invention is to provide a hammock for a child's cot, stand or frame which offers a useful alternative choice.

Further objects and advantages of the invention will become apparent from the following description which is given by way of example only.

SUMMARY OF THE INVENTION

In its broadest scope the invention provides a hammock for a child's cot, stand or frame, the hammock including a generally rectangular or oval frame dimensioned either to fit within a cot or be suspended from a stand or frame, the rectangular or oval frame having supported relative thereto a fabric hammock region, the frame or fabric region having means for supporting same relative to either the sides or ends of the cot, frame or stand to thereby provide a sleeping platform suspended within the cot or from the frame or stand.

In accordance with another aspect of the invention there is provided a combination hammock and associated stand or frame for a child, the hammock including a generally rectangular or oval frame dimensioned to be suspended from a stand or frame, the rectangular or oval frame having supported relative thereto a fabric hammock region, the frame or fabric region having means for supporting same relative to the frame or stand to thereby provide a sleeping platform suspended within or from the frame or stand.

The rectangular or oval frame can be constructed from wood, a plastics material or a light metal alloy.

The means for supporting the rectangular or oval frame or fabric region relative to the cot can be one or more toggles connected by cords linking the toggles to the rectangular or oval frame or fabric, the toggles being engaged between the bars of the cot to support the fabric region above a mattress of the cot or from the frame or stand.

Alternatively the means for supporting the rectangular frame or fabric can be any suitable means for connecting cords or the like to the frame or stand.

The fabric region can be sleeve shaped with a rectangular frame inserted therein or may be a rectangular member with recesses sewn along each side in which side rails of the rectangular frame are fitted.

For further understanding of the nature and advantages of the invention, reference should be had to the ensuing detailed description taken in conjunction with the accompanying drawings.

DESCRIPTIONS OF THE PREFERRED EMBODIMENTS

Figure 1:
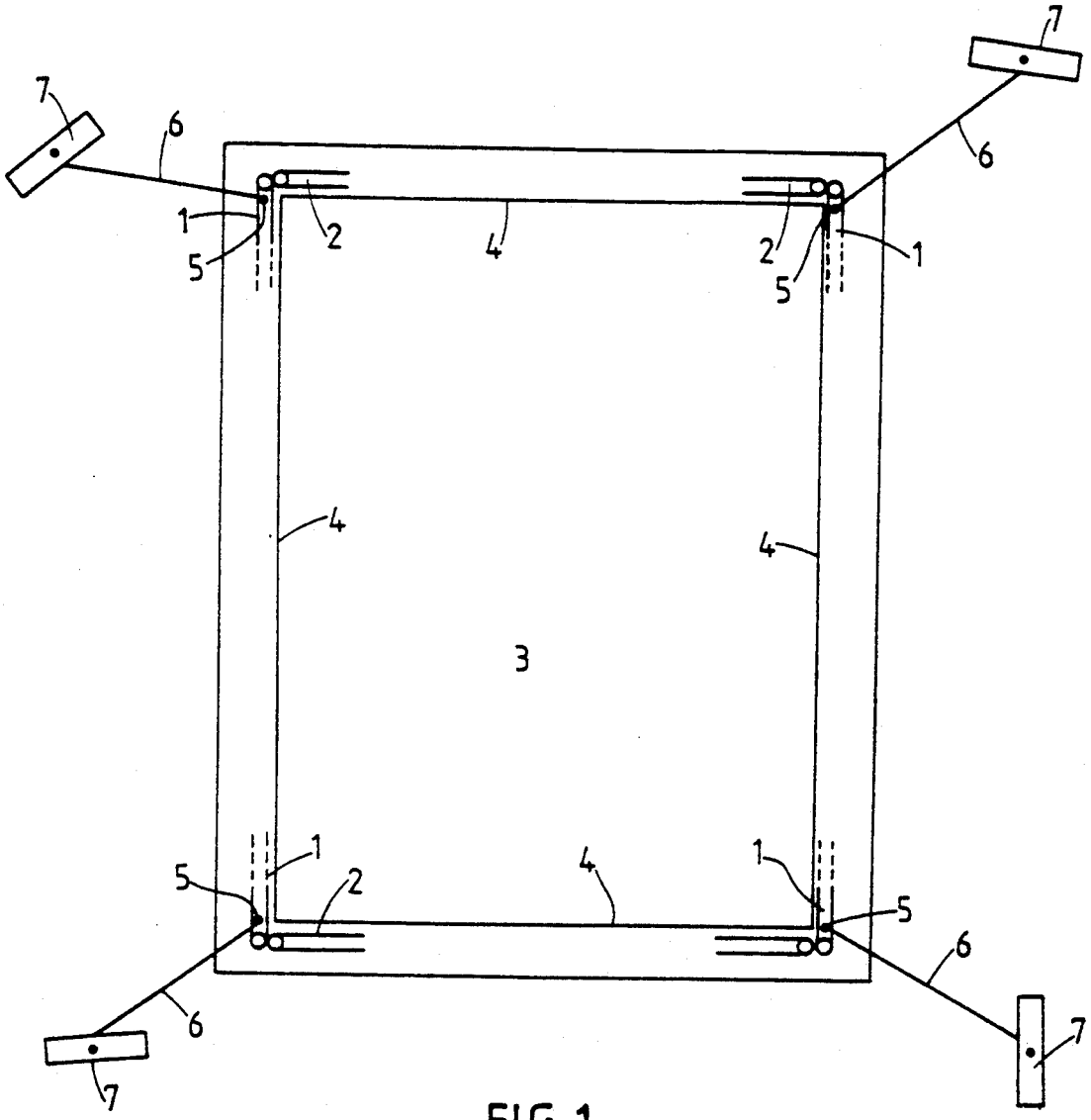
FIG. 1 is a plan view of an example of hammock according to the invention.

Turning now to the drawings. FIG. 1 the hammock has a metal or wooden frame (shown dotted) which is generally rectangular in shape. The rectangular frame consists of side members 1 and members 2 which are slightly less than 1 meter in length and 500 mm in width. The members 1 and 2 are joined at their corners by welds or the like in the case of metal members or by dowels, screws or bolts in the case of wooden members.

The rectangular frame has supported thereon a fabric region 3 which can be a sheet of fabric with seams 4 sewn in its four sides to form tubular recesses in which the frame members 1 and 2 are inserted.

The frame members 1 have holes 5 drilled therethrough. The holes are for cords 6 at the free ends of which are toggles 7. Alternatively (not shown) the cords 6 can be joined to the fabric if this is suitable. The corners or other parts of the rectangular frame can be padded to protect a user of the hammock. In the case of metal members the cords 6 can be protected where they contact the metal by providing plastics, rubber or the like members through which the cords extends.

Figure 2:
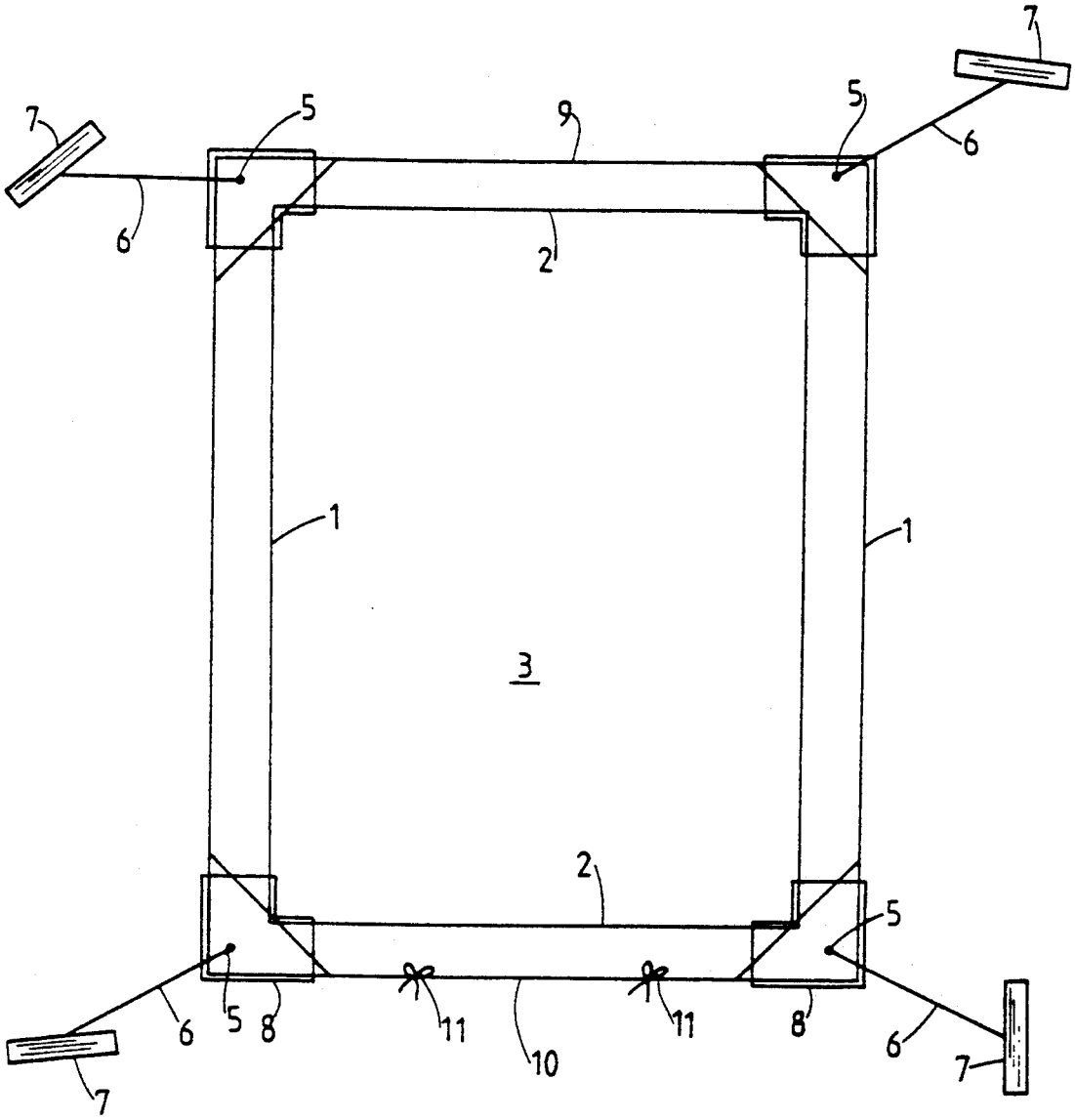
FIG. 2 is a plan view of an alternative example of hammock according to the invention.

In the second example shown in FIG. 2 the parts are referenced with the same numerals as the first example. In this case the members 1 and 2 are constructed from a rigid plastics or plastics reinforced pipe or rod at the corners of which are moulded plastics elbows 8.

In this case the fabric region 3 is made as a double thickness of fabric forming a sleeve or casement one end 9 of which is closed while the other end 10 is closed and the fabric held tight by fastening means like tapes, domes, Velcro fastening tape or ribbon at 11.

Figure 3:
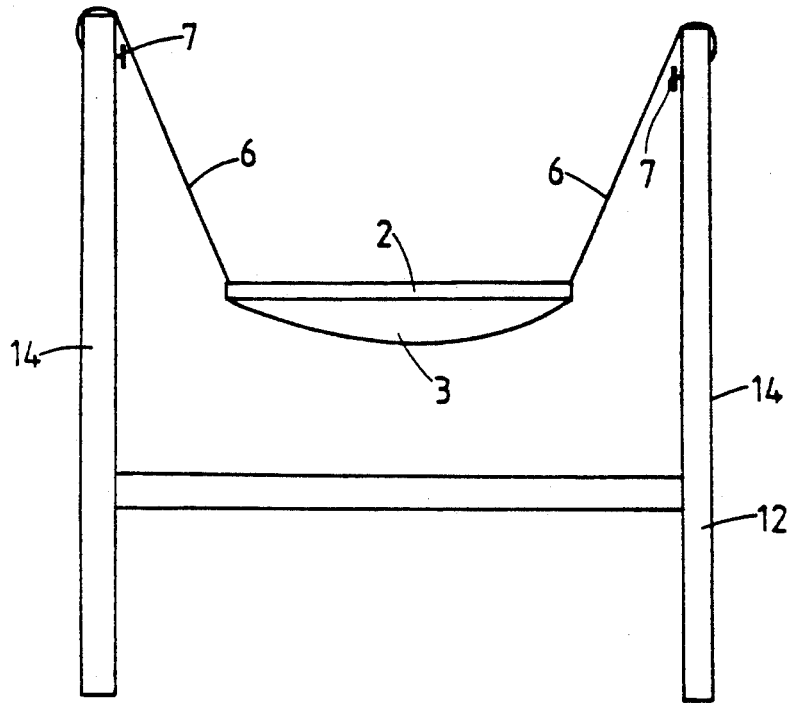
FIG. 3 is a view of a cot from one end, with its end walls removed and showing the hammock supported therein.
Figure 4:
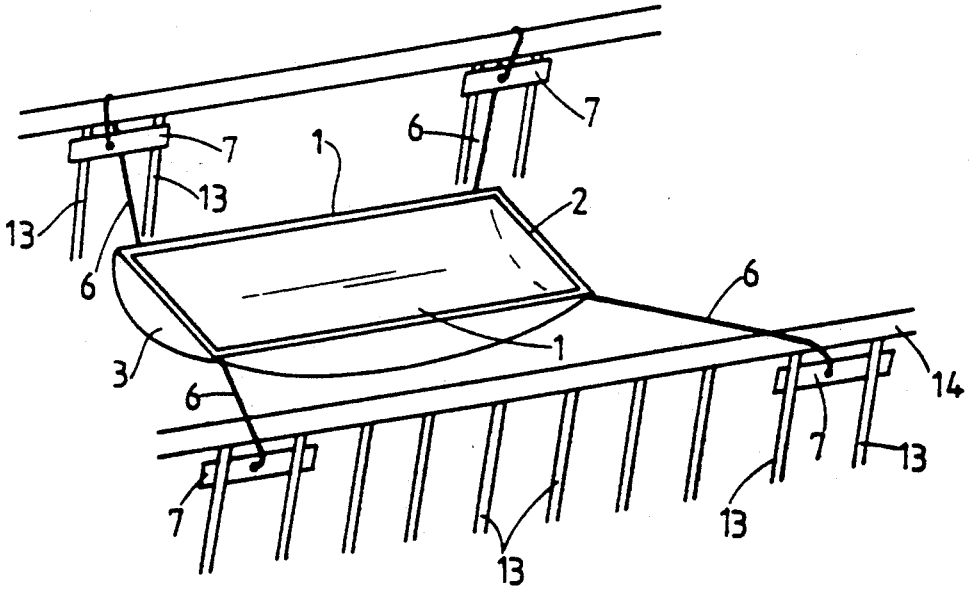
FIG. 4 is a perspective view from above of part of the cot shown in FIG. 3 with the hammock supported therein.

In use the hammocks can be placed in a cot 12 as shown in FIGS. 3 and 4. The toggles 7 are engaged through the bars 13 of the sides 14 of the cot and turned sideways to lock against the inside of the bars 13.

The fabric region can be padded or a light padded cover can be placed on the fabric which itself is readily removable for repair or cleaning.

In practice the length of the cords 7 can be adjustable to suit a users requirements and the age of the child to be placed in the cot. An advantage of the invention is that the sleeping level of a child can be adjusted to suit a user and reduce the extent to which a parent needs to bend while tending a small child. The hammock when slung in the cot can be easily rocked from end to end and to a smaller extent from side to side therefore making it easier to pacify and soothe the child.

In an alternative not shown in the drawings the hammock is suspended from a frame or stand. In this construction the means for supporting the rectangular frame can be a cord or the like attached by a connection on the frame or stand or the end of the cord.

Thus by this invention there is provided a child's cot hammock which provides a relatively soft and rockable surface.

The above description and illustrations should not be construed as limiting the scope of the invention, which is defined by the appended claims.

What is claimed is:

1. A hammock adapted for mounting on a carrier which has at least two sides extending upward from a bottom surface, said hammock comprising:

a) a frame assembly comprising a plurality of members and elbows, said members being interconnected at the elbows;

b) bed means for supporting a child, said bed means being integral with the frame assembly, c) a plurality of cord means emanating from the frame assembly for detachably mounting the hammock to the at least two sides of the carrier with the bed means supported between the sides of the carrier a distance above the surface, said cord means comprising support cords having free ends to which are attached toggle means for attaching the hammock to the carrier, said cord means being positioned at or near the elbows of the assembly frame so as to permit rocking of the hammock when the hammock is mounted on the carrier, said hammock having two opposing ends, said cord means being positioned on the frame assembly such that the rocking of said hammock is predominantly end to end when the hammock is mounted on the carrier.

2. A hammock assembly as claimed in claim 1 wherein the hammock is adapted for mounting on a carrier having bars on each of the at least two sides, and wherein the toggle means are adapted for detachable engagement through the bars of the at least two sides of the carrier.

3. A hammock assembly as claimed in claim 2 wherein the toggle means comprise toggles which can be oriented with respect to the bars in either of at least two positions, a first position wherein the toggles can be slipped through the bars, and a second position wherein the toggles cannot be slipped through the bars.

4. A hammock assembly comprising a hammock and a carrier, said carrier having a bottom surface and at least two sides extending upward therefrom, said hammock comprising i) a frame ii) bed means for supporting a child, and iii) a plurality of cord means emanating from the frame for detachably mounting the hammock to the at least two sides of the carrier with the bed means supported between the sides of the carrier a distance above the bottom surface, said carrier having vertical bars on each of the at least two sides, said cord means having toggles for engagement through the bars of the at least two sides, said cord means being mounted on the frame so as to permit rocking of the hammock when the hammock is mounted on the carrier with the toggles engaged through the bars of the at least two sides.

* * * * *